US008286869B1

(12) United States Patent
Grant

(10) Patent No.: US 8,286,869 B1
(45) Date of Patent: Oct. 16, 2012

(54) CASE LABELING FOR FIELD-PACKED PRODUCE

(75) Inventor: Elliott Grant, Woodside, CA (US)

(73) Assignee: YottaMark, Inc., Redwood City, CA (US)

( * ) Notice: Subject to any disclaimer, the term of this patent is extended or adjusted under 35 U.S.C. 154(b) by 0 days.

(21) Appl. No.: 13/449,145

(22) Filed: Apr. 17, 2012

Related U.S. Application Data

(63) Continuation of application No. 13/221,520, filed on Aug. 30, 2011, now Pat. No. 8,196,827, which is a continuation-in-part of application No. 12/471,201, filed on May 22, 2009, now Pat. No. 8,152,063.

(51) Int. Cl.
*G06Q 90/00* (2006.01)

(52) U.S. Cl. ..... 235/385; 702/19

(58) Field of Classification Search ..... 235/385; 702/19

See application file for complete search history.

(56) References Cited

U.S. PATENT DOCUMENTS

| | | | |
|---|---|---|---|
| 3,329,181 | A | 7/1967 | Buss |
| 4,385,482 | A | 5/1983 | Booth |
| 4,526,404 | A | 7/1985 | Vazquez |
| 4,544,590 | A | 10/1985 | Egan |
| 4,832,204 | A | 5/1989 | Handy et al. |
| 4,846,504 | A | 7/1989 | MacGregor et al. |
| 5,136,826 | A | 8/1992 | Carson et al. |
| 5,271,642 | A | 12/1993 | Jahier et al. |
| 5,343,529 | A | 8/1994 | Goldfine et al. |
| 5,360,628 | A | 11/1994 | Butland |
| 5,361,904 | A | 11/1994 | Kapec et al. |
| 5,478,990 | A | 12/1995 | Montanari et al. |
| 5,486,686 | A | 1/1996 | Zdybel, Jr. et al. |
| 5,561,970 | A | 10/1996 | Edie et al. |
| 5,569,317 | A | 10/1996 | Sarada et al. |
| 5,592,561 | A | 1/1997 | Moore |
| 5,611,948 | A | 3/1997 | Hawkins |
| 5,619,416 | A | 4/1997 | Kosarew |

(Continued)

FOREIGN PATENT DOCUMENTS

| | | | |
|---|---|---|---|
| CN | 1350265 | A | 5/2002 |

(Continued)

OTHER PUBLICATIONS

PCT/US08/75626 International Search Report and Written Opinion, Nov. 26, 2008.

(Continued)

*Primary Examiner* — Kristy A Haupt
(74) *Attorney, Agent, or Firm* — Peters Verny, LLP

(57) ABSTRACT

Rolls of pre-printed case labels are distributed at a harvest for labeling cases of produce. The labels on each roll include sequential codes that each span a unique range. Part or all of each roll's range can be associated with harvest data, including picker and block identifications. The association can be made by placing a label from each roll on a harvest form bearing harvest data, or by entering harvest data into an electronic device and using the device to read a unique code from a label. Pickers then harvest produce, fill cases, and label the cases from their rolls. The association of ranges to pickers allows a subsequently read unique code from a filled case to be properly credited to the correct picker. The association of ranges to blocks allows subsequently obtained quality information to be correlated to specific blocks.

7 Claims, 11 Drawing Sheets

U.S. PATENT DOCUMENTS 5,668,803 A 9/1997 Tymes et al.
5,695,071 A 12/1997 Ross et al.
5,768,384 A 6/1998 Berson
5,793,030 A 8/1998 Kelly, Jr.
5,895,073 A 4/1999 Moore
5,917,925 A 6/1999 Moore
6,005,960 A 12/1999 Moore
6,041,929 A 3/2000 Brunner et al.
6,069,955 A 5/2000 Coppersmith et al.
6,111,953 A 8/2000 Walker et al.
6,203,069 B1 3/2001 Outwater et al.
6,211,789 B1 4/2001 Oldham et al.
6,212,638 B1 4/2001 Lee et al.
6,226,619 B1 5/2001 Halperin et al.
6,231,435 B1 5/2001 Pilger
6,246,778 B1 6/2001 Moore
6,297,508 B1 10/2001 Barmore et al.
6,308,165 B1 10/2001 Gilham
6,314,337 B1 11/2001 Marcum
6,329,920 B1 12/2001 Morrison et al.
6,342,839 B1 1/2002 Curkendall et al.
6,346,885 B1 2/2002 Curkendall
6,349,292 B1 2/2002 Sutherland et al.
6,361,079 B1 3/2002 Kirkman
6,363,483 B1 3/2002 Keshav
6,364,990 B1 4/2002 Grosskopf et al.
6,398,106 B1 6/2002 Ulvr et al.
6,409,082 B1 6/2002 Davis et al.
6,428,640 B1 8/2002 Stevens et al.
6,442,276 B1 8/2002 Doljack
6,456,729 B1 9/2002 Moore
6,473,739 B1 10/2002 Showghi et al.
6,536,672 B1 3/2003 Outwater
6,547,137 B1 4/2003 Begelfer et al.
6,591,252 B1 7/2003 Young
6,612,494 B1 9/2003 Outwater
6,664,897 B2 12/2003 Pape et al.
6,680,783 B1 1/2004 Pierce et al.
6,766,324 B2 7/2004 Carlson et al.
6,788,800 B1 9/2004 Carr et al.
6,796,504 B2 9/2004 Robinson
6,805,926 B2 10/2004 Cole et al.
6,806,478 B1 10/2004 Hatfield
6,808,574 B1 10/2004 Stevens et al.
6,859,672 B2 2/2005 Roberts et al.
6,974,298 B2 12/2005 Tanaka
6,991,261 B2 1/2006 Dronzek, Jr. et al.
6,995,675 B2 2/2006 Curkendall et al.
6,996,543 B1 2/2006 Coppersmith et al.
7,009,723 B1 3/2006 Bartholet et al.
7,013,286 B1 3/2006 Aggarwal et al.
7,040,532 B1 5/2006 Taylor et al.
7,043,442 B2 5/2006 Levy et al.
7,104,450 B2 9/2006 Khovaylo
7,207,481 B2 4/2007 Barenburg et al.
7,211,163 B2 5/2007 Kennedy
7,222,791 B2 5/2007 Heilper et al.
7,261,235 B2 8/2007 Barenburg et al.
7,277,601 B2 10/2007 Zorab et al.
7,283,630 B1 10/2007 Doljack
7,295,114 B1 11/2007 Drzaic et al.
7,321,310 B2 1/2008 Curkendall et al.
7,412,461 B2 8/2008 Sholl et al.
7,519,825 B2 4/2009 Geoffrey
7,686,513 B2 3/2010 Knoerzer et al.
7,705,735 B2 4/2010 Pape et al.
7,714,729 B2 5/2010 Pape et al.
7,766,240 B1 8/2010 Grant
7,810,726 B2 10/2010 de la Huerga
7,827,058 B2 11/2010 Mortimer
7,909,239 B2 3/2011 Grant et al.
8,019,662 B2 9/2011 Lucas
8,108,309 B2 1/2012 Tan
8,140,852 B2 3/2012 Guenter et al.
2001/0056359 A1 12/2001 Abreu
2002/0004767 A1 1/2002 Okamoto et al.
2002/0131442 A1 9/2002 Garg et al.
2002/0158765 A1 10/2002 Pape et al.
2002/0178363 A1 11/2002 Ambrogio et al.
2003/0019186 A1 1/2003 Hakansson
2003/0070520 A1 4/2003 Gawazawa
2003/0080191 A1 5/2003 Lubow et al.
2003/0089078 A1 5/2003 Christina
2003/0164934 A1 9/2003 Nishi et al.
2003/0177025 A1 9/2003 Curkendall et al.
2003/0177095 A1 9/2003 Zorab et al.
2003/0185948 A1 10/2003 Garwood
2003/0221108 A1 11/2003 Rupp
2004/0065053 A1 4/2004 Rice et al.
2004/0159527 A1 8/2004 Williamson
2004/0167829 A1 8/2004 Fujita
2004/0200892 A1 10/2004 Curkendall et al.
2004/0205343 A1 10/2004 Forth et al.
2004/0230796 A1 11/2004 Lundvall et al.
2005/0004682 A1 1/2005 Gaddis et al.
2005/0038756 A1 2/2005 Nagel
2005/0097054 A1 5/2005 Dillon
2005/0108044 A1 5/2005 Koster
2005/0182695 A1 8/2005 Lubow et al.
2005/0206586 A1 9/2005 Capurso et al.
2005/0247778 A1 11/2005 Roberts
2005/0251449 A1 11/2005 Pape et al.
2005/0288947 A1 12/2005 Mallonee et al.
2006/0004907 A1 1/2006 Pape et al.
2006/0022059 A1 2/2006 Juds
2006/0054682 A1 3/2006 de la Huerga et al.
2006/0100964 A1 5/2006 Wilde et al.
2006/0111845 A1* 5/2006 Forbis et al. ..... 702/19
2006/0161443 A1 7/2006 Rollins
2006/0180661 A1 8/2006 Grant et al.
2006/0187048 A1 8/2006 Curkendall et al.
2006/0259182 A1 11/2006 Mantell
2006/0260495 A1 11/2006 Siedlaczek
2006/0266827 A1 11/2006 Hamilton
2006/0289654 A1 12/2006 Robinson et al.
2007/0001006 A1 1/2007 Schuessler et al.
2007/0051362 A1 3/2007 Sullivan et al.
2007/0119954 A1 5/2007 Barenburg et al.
2007/0119955 A1 5/2007 Barenburg et al.
2007/0170240 A1 7/2007 Grant et al.
2007/0175974 A1 8/2007 Self et al.
2007/0203724 A1 8/2007 Farmer et al.
2007/0203818 A1 8/2007 Farmer et al.
2007/0205258 A1 9/2007 Self et al.
2007/0219916 A1 9/2007 Lucas
2008/0011841 A1 1/2008 Self et al.
2008/0011843 A1 1/2008 Barenburg et al.
2008/0023472 A1 1/2008 Brandt
2008/0030348 A1 2/2008 Pape et al.
2008/0046263 A1 2/2008 Sager et al.
2008/0143094 A1 6/2008 Goetz
2008/0178197 A1 7/2008 Pape et al.
2008/0215484 A1 9/2008 Oldham et al.
2009/0242631 A1 10/2009 Wishnatzki et al.
2010/0106660 A1 4/2010 Farmer et al.
2010/0145730 A1 6/2010 Abreu
2011/0098026 A1 4/2011 Uland
2012/0037697 A1 2/2012 Boone et al.

FOREIGN PATENT DOCUMENTS

JP 2000011114 A2 1/2000
JP 2002140449 A2 5/2002
WO 2003007252 A1 1/2003
WO 2006084090 A2 8/2006
WO 2007140018 A2 6/2007

OTHER PUBLICATIONS

Secure Symbology, Inc. Business Overview, May 2008.
Paul Chang, IBM Industry Forum 2010, Mexico Industry Event, 2010.
PCT1US06/03768 International Search Report and Written Opinion, Jun. 12, 2008.
"CRC: Implementation," http://www.relisoft.com/science/CrcNaive.html, 2006.
Yoichi Shibata et al., "Mechanism-based PKI," Computer System Symposium 2003, vol. 2003 (15), pp. 181-186, (1998).

U.S. Appl. No. 12/501,240 non-final Office action, mailed Jun. 7, 2011.
U.S. Appl. No. 12/501,240 Applicants' Amendment A, submitted Oct. 7, 2011.
U.S. Appl. No. 12/501,240 non-final Office action, mailed Jan. 13, 2012.
U.S. Appl. No. 12/501,240 Applicant Initiated Interview Summary, mailed Mar. 12, 2012.
U.S. Appl. No. 12/370,346 non-final Office action, mailed Aug. 9, 2011.
U.S. Appl. No. 12/370,346 Applicants' Amendment A, submitted Oct. 27, 2011.
U.S. Appl. No. 12/370,346 non-final Office action, mailed Feb. 8, 2012.
U.S. Appl. No. 12/206,156 non-final Office action, mailed Nov. 15, 2010.
U.S. Appl. No. 12/206,156 Applicants' Amendment A, submitted Jan. 10, 2011.
Ilic, A. et al., "The Value of Sensor Information for the Management of Perishable Goods—A Simulation Study" (Jun. 4, 2008), http://www.im.ethz.ch/publications/ilic_voi_perishables_perceived_quality_0608.pdf.
Roberti, M., "RFID Will Help Keep Perishables Fresh" (Aug. 3, 2005), RFID Journal, www.rfidjournal.com/article/view/1775.
U.S. Appl. No. 12/501,240 Applicants' Amendment B, submitted Mar. 27, 2012.
U.S. Appl. No. 12/370,346 Applicants' Amendment B, submitted Mar. 22, 2012.
U.S. Appl. No. 12/370,346 final Office action, mailed Jul. 31, 2012.
U.S. Appl. No. 13/053,200 non-final Office action, mailed Aug. 15, 2012.
U.S. Appl. No. 12/580,506, Elliott Grant, Method and System for Deterring Product Counterfeiting, Diversion and Piracy, Oct. 16, 2009.
U.S. Appl. No. 12/370,346, J. Scott Carr, Systems and Methods of Associating Individual Packages with Harvest Crates, Feb. 12, 2009.
U.S. Appl. No. 12/689,949, Elliott Grant, Voice Code with Primary and Secondary Digits, Jan. 19, 2010.
U.S. Appl. No. 12/143,016, Elliott Grant, Duo Codes for Product Authentication, Jun. 20, 2008.
U.S. Appl. No. 12/850,909, Elliott Grant, Method and System for Deterring Product Counterfeiting, Diversion and Piracy, Aug. 5, 2010.
U.S. Appl. No. 13/053,200, Elliott Grant, Attributing Harvest Information with Unique Identifiers, Mar. 21, 2011.
U.S. Appl. No. 12/877,467, Elliott Grant, Lot Identification Codes for Packaging, Sep. 8, 2010.
U.S. Appl. No. 13/004,173, Elliott Grant, Systems and Methods for using a Search Engine to Implement Product Traceability, Jan. 11, 2011.
U.S. Appl. No. 12/908,667, Elliott Grant, Methods for Correlating First Mile and Last Mile Product Data, Oct. 20, 2010.
U.S. Appl. No. 13/431,983, Elliott Grant, Mobile Table for Implementing Clamshell-to-Case Association, Mar. 28, 2012.
U.S. Appl. No. 13/471,181, Elliott Grant, Methods for Assigning Traceability Information to and Retrieving Traceability Information from a Store Shelf, May 14, 2012.
U.S. Appl. No. 13/554,502, Elliott Grant, Attributing Harvest Information with Unique Identifiers, Jul. 20, 2012.

* cited by examiner

CASE LABELING FOR FIELD-PACKED PRODUCE

CROSS-REFERENCE TO RELATED APPLICATIONS

This application is a Continuation of U.S. patent application Ser. No. 13/221,520 filed on Aug. 30, 2011 now U.S. Pat. No. 8,196,827 and entitled "Case Labeling for Field-Packed Produce" which is a Continuation-In-Part of U.S. patent application Ser. No. 12/471,201 filed on May 22, 2009 now U.S. Pat. No. 8,152,063 and also entitled "Case Labeling for Field-Packed Produce." This application is related to U.S. patent application Ser. No. 12/370,346 filed Feb. 12, 2009 and entitled "Systems and Methods of Associating Individual Packages with Harvest Crates," U.S. patent application Ser. No. 12/206,156 filed Sep. 8, 2008 and entitled "Attributing Harvest Information with Unique Identifiers," now U.S. Pat. No. 7,909,239 issued on Mar. 22, 2011, U.S. patent application Ser. No. 12/176,334 filed Jul. 19, 2008 and entitled "Case-Level Traceability Without the Need for Inline Printing," now U.S. Pat. No. 7,766,240 issued on Aug. 3, 2010, and abandoned U.S. patent application Ser. No. 12/414,123 filed Mar. 30, 2009 and entitled "Parent Case Labels with Multiple Child Labels for Field Packed Produce." Each of the aforementioned applications is incorporated herein by reference.

BACKGROUND OF THE INVENTION

1. Field of the Invention

The invention relates generally to the field of product traceability and more particularly to labels that can be used to associate information with cases of produce.

2. Description of the Prior Art

The Produce Traceability Initiative (PTI) is an initiative designed to improve traceability through the entire produce supply chain from the point of harvest to the point of sale. Compliance with the initiative requires printing a date- and a stock-keeping unit (SKU)-specific label on every case. For field-packed produce, this labeling requirement creates several challenges.

First, printing labels in the field is impractical due to technology and cost limitations. Printing labels in advance is not a suitable alternative because the number of labels that will be needed on any particular date can be difficult to predict. Similarly, the appropriate SKU or SKUs for a particular date can also be difficult to predict. For example, it may not be determined until just before a strawberry field is harvested whether the berries will be packed in 1 lb or 2 lb clamshells, and the correct SKU depends on the packaging. Printing enough labels to cover all eventualities for any particular day leads to significant waste of unused labels and unacceptable cost. Lastly, it is possible to print and apply labels at a location away from the field, such as when the cases and pallets reach the cooler, but doing so slows down receiving at the cooler and can be logistically impractical.

SUMMARY

Methods for labeling cases of field-packed produce are provided. An exemplary method comprises distributing rolls of labels at a harvest event where each label of every roll including a common code including a company identifier and a SKU, where each label on each roll has a common batch number, and where the batch numbers on the labels of different rolls are different. The method further comprises removing case labels from the rolls and affixing the labels to produce cases before, during or after the harvest event, and storing associations between the batch numbers and harvest event data for the harvest event. In various embodiments the common code comprises a GTIN. The batch number and the common code can be arranged in series using industry standard headers to form a composite code, in some instances. The common code can be displayed in either or both a human-readable format and a machine-readable format. The exemplary method can further comprise stamping either or both of the date and a ranch stamp on each case label. The exemplary method can further comprise marking the date on each case label with a date label, for example, with a label gun or writing by hand.

In various embodiments, storing the associations includes reading the batch numbers from the case labels, such as with a handheld scanner. In other embodiments, storing the associations includes affixing another case label from each distributed roll to a harvest form. In some of these latter embodiments storing the associations includes reading the batch numbers from the case labels on the harvest forms. Also, some of these latter embodiments further comprise entering harvest event data on the harvest form.

Case labels are also provided herein for field-labeling produce cases. An exemplary set of case labels comprises a plurality of rolls of labels. Each label of every roll includes a common code including a company identifier and a SKU. Further, each label on each roll has a common batch number, and the batch numbers on the labels of different rolls are different. Each label in the set can also include a unique code, in some embodiments. Each label in the set can further comprise any or all of a commodity or variety of produce, a packing configuration, a country of origin, a URL, a field for stamping the date, and a field for stamping a ranch stamp.

Another exemplary method comprises printing multiple sets of rolls of case labels. Within each set of rolls each case label of every roll includes a common SKU, each case label on each roll has a common batch number, and the batch numbers on the case labels of different rolls are different. The sets are differentiated in that the common SKU for each set is different. The exemplary method further comprises storing, for each set, associations between the SKU for the set and the batch numbers of the rolls of the set. The exemplary method further can comprise printing a unique code on each case label. Some embodiments further comprise selecting a set of rolls of case labels based on the SKU for the set, and distributing the rolls of the set at a harvest event. In some of the embodiments the method further comprises labeling cases of produce from the harvest event with case labels from the distributed rolls and storing associations between the batch numbers and harvest event data for the harvest event.

Still another exemplary method for labeling field-packed produce comprises associating harvest event data, including a picker identification for a picker, to create a data record, and associating an initial label of a roll of labels to the data record, where each label of the roll includes a unique code following a sequence, and in various embodiments each label further includes a company identifier and a SKU. The method further comprises harvesting produce by the picker, filling cases with the harvested produce, and affixing labels from the roll to the filled cases, and associating a first range of unique codes to the data record, where the first range begins with a unique code included on the initial label. In some embodiments, associating the first range of unique codes to the data record comprises searching a database using the unique code to identify a second range of unique codes for a roll of labels, where the second range includes the unique code, and wherein the first range comprises a subset of the second range.

In some embodiments, creating the data record includes recording harvest event data on a harvest form, and in some of these embodiments recording harvest event data on the harvest form includes affixing a block identification label to the harvest form, and/or associating the initial label of a roll of labels to the data record includes affixing the initial label to the harvest form.

Creating the data record alternately may include entering harvest event data into a handheld computing device. In these embodiments entering harvest event data into the handheld computing device can include reading the picker identification from a picker's badge using the handheld computing device. In these embodiments, associating the initial label of a roll of labels to the data record can include reading a unique code from the initial label using the handheld computing device.

In various embodiments the method further comprises reading the unique codes on each filled case at an aggregation point, such as a table or a finished pallet. Each read unique code is stored as a record of a filled case to be credited to a picker. These methods can further comprise tabulating a number of cases filled by the picker by matching these read unique codes against the ranges of unique codes associated with the picker amongst the established data records.

Yet other methods of the invention pertain to crediting pickers and compensating pickers. An exemplary method for a picker to receive credit for a number of filled cases at a harvest event consists of presenting an identification badge to be read and receiving a roll of labels, then harvesting produce, filling the number of cases with the harvested produce, and affixing labels from the roll to each of the filled cases. Another exemplary method for receiving compensation for a number of filled cases at a harvest event comprises presenting an identification badge to be read and receiving a roll of labels, harvesting produce, filling a number of cases with the harvested produce, and affixing labels from the roll to each of the filled cases, and receiving the compensation for the number of filled cases. In some of these embodiments receiving compensation for the number of filled cases occurs without the picker having to present the identification badge to be read at a case aggregation point. Each label of the roll in these various embodiments includes a company identifier, a SKU, and a unique code following a sequence.

Further methods of the invention are directed to the actions of a third party service provider that coordinates information between label suppliers and agricultural producers. An exemplary method comprises storing sequences of unique codes in a database, each sequence spanning a range, providing the sequences of unique codes to be used on labels, receiving a unique code, and searching the database to determine a range within which the unique code falls. In various embodiments, the method can further comprise generating the sequences of unique codes before storing the sequences.

Some embodiments are directed towards storing harvest event data in association with block and picker identifications and with ranges of codes for traceability and to permit subsequently obtained quality assessments to be compared as a function of the block of origin and/or the specific picker. The associations of the ranges to the harvest event data can be performed by either the host computing system, that of the service provided, or the client computing system of the agricultural producer. Accordingly, some embodiments can further comprise receiving harvest event data in association with the unique code when receiving the unique code. Other embodiments further comprise providing the determined range to the source of the unique code, and in some of these embodiments the method further comprises receiving harvest event data in association with the unique code after providing the determined range to the source of the unique code. Still further embodiments can further comprise receiving quality assessment data associated with at least some of the unique codes within the provided ranges.

DETAILED DESCRIPTION OF THE INVENTION

The present invention provides pre-printed case labels that can be conveniently affixed to cases of produce in the field during a harvest to provide case-level traceability. The case labels are pre-printed with a batch number and information about the harvested produce, including a company identifier and a SKU, but are not pre-printed with the harvest date. The case labels can be provided on rolls, where each case label on a roll has the same batch number, but the case labels on different rolls have different batch numbers. Harvest event data, such as the date, can be associated with the batch, company identifier and a SKU numbers and stored for later use, should a question ever arise that requires tracing back through the distribution chain. It will be understood that although the present invention is illustrated below with specific reference to the traceability of field-packed produce, the present invention can also be used to provide traceability to other commodities as well, such as seafood or nuts.

Figure 1:
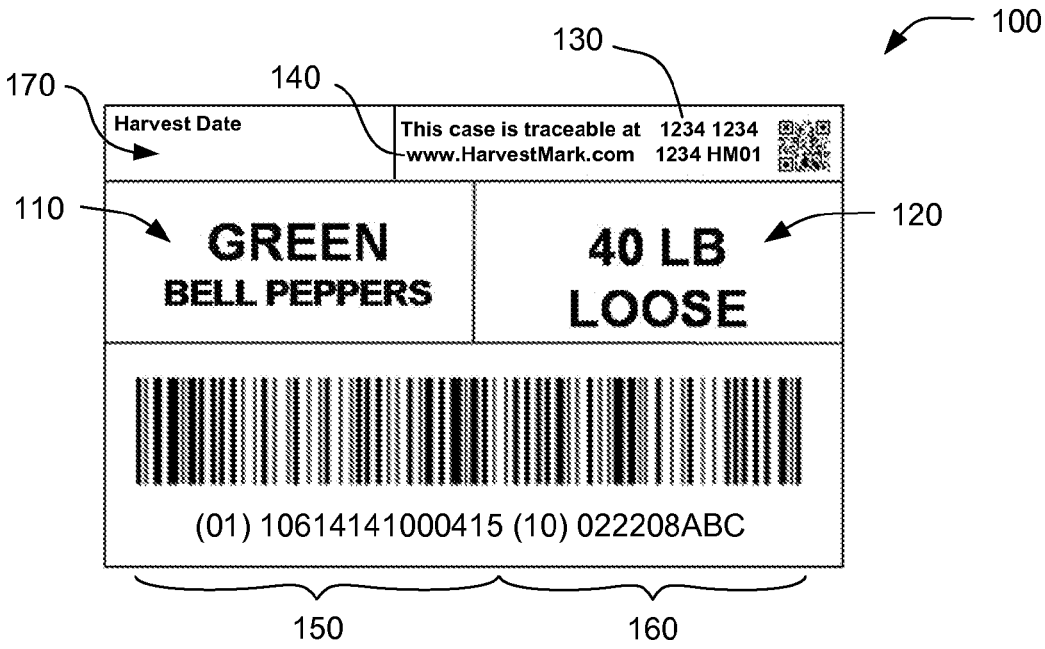
FIG. 1 provides a case label according to an exemplary embodiment of the present invention.
Figure 2:
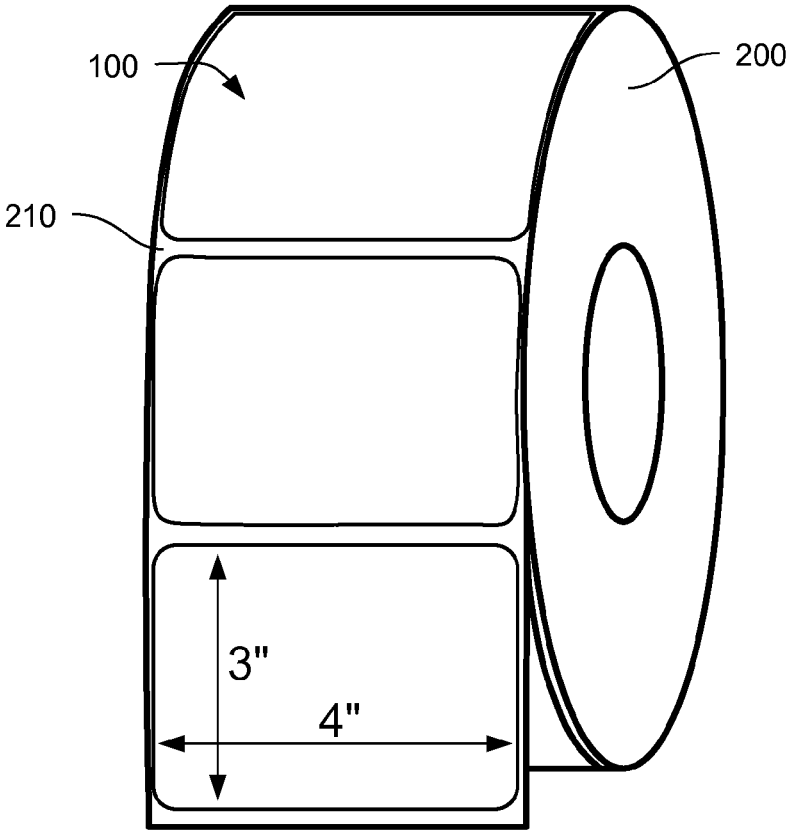
FIG. 2 shows a roll of case labels according to an exemplary embodiment of the present invention.

FIG. 1 illustrates a pre-printed case label 100 according to an exemplary embodiment. The case label 100, in some embodiments, can include an adhesive backing, though it will be appreciated that the case label 100 can also be secured to a case in other ways. The case label 100 can be one of a plurality of case labels 100 on a roll 200 as seen in FIG. 2. Harvest crews, working in the field, take rolls 200 of case labels 100 and affix the case labels 100 to cases of produce that are part of a common lot. Methods for associating information with the case labels 100 are discussed in greater detail below with respect to FIG. 3.

The case label 100 comprises several fields to provide various information. In some embodiments, the case label 100 includes a field for the commodity or variety of the produce to be packed 110, green bell peppers in the example of FIG. 1. The case label 100 can also include a field for the packing configuration 120 (e.g. 40 LB loose). The name and address of the packer or shipper and/or the country of origin can be in still other fields on the case label 100 if not otherwise pre-printed on the case.

In some embodiments, the case label 100 also comprises a field including a unique code 130 that represents a case serial number, and in further embodiments the same or another field comprises a URL 140 for a website through which lot-specific information can be obtained, and feedback given, for the given unique code 130. Exemplary methods for generating and printing suitable unique codes are described, for example, in U.S. patent application Ser. No. 11/743,648 filed on May 2, 2007 and entitled "System and Method of Product Information Coding and Authentication" which is a Continuation-in-Part of U.S. patent application Ser. No. 11/347,424 filed on Feb. 2, 2006 and entitled "Method and System for Deterring Product Counterfeiting, Diversion and Piracy," which claims priority from U.S. Provisional Patent Application No. 60/650,364 filed on Feb. 3, 2005 and entitled "System, Method and Technique for Combating Product Counterfeiting, Piracy and Diversion," each of which is incorporated herein by reference.

Still another field can provide a code 150 that represents the packaging level, a company identifier, a SKU number, and a checksum digit. An exemplary company identifier comprises a GS1 company prefix such as "0641414" in FIG. 1. In some embodiments code 150 is 14 digits and comprises a Global Trade Item Number (GTIN). The code 150 can be in either or both of a machine-readable format and a human-readable format, and is shown in FIG. 1 as human-readable text beneath a machine-readable GS1-128 barcode. In the illustrated embodiment, the code 150 is preceded by the Application Identifier (01) to indicate that it is a GS1 standard GTIN.

Yet another field can provide a lot or batch number 160 that is used to associate information with the contents of the labeled cases. The batch number 160 can be up to 20 alphanumeric characters, in some instances. In other instances the batch number 160 can consist of any integer number of alphanumeric characters from one to 20, such as the nine alphanumeric characters in the illustrated embodiment. More commonly, the batch number 160 consists of six to 20 alphanumeric characters. The batch number 160 can also be in either or both of a machine-readable format and a human-readable format. In FIG. 1 the batch number 160 is shown as human readable text beneath a GS1-128 barcode. In the illustrated embodiment, the batch number 160 is preceded by the Application Identifier (10) to indicate that it is a GS1 standard batch (or lot) number. In some embodiments the code 150 and the batch number 160 are arranged in series to form a composite code, as shown in FIG. 1.

In some instances a harvest or pack date may be required, such as by the retailer, and in these instances the case label 100 can further include a field 170 where the date can be added to the label at the time of use. In some embodiments, the field 170 includes the word "date" alone or in a short phrase such as "harvest date" or "stamp date here." It will be appreciated that the date of use will typically not be known in advance at the time that the case labels 100 are printed, thus the date itself is not pre-printed. Still another blank field (not shown) that can be included on the case label 100 is one to receive a ranch stamp or similar identifying mark to identify the ranch and/or ranch lot without having to resort to a database look-up.

As noted above, FIG. 2 illustrates a roll 200 of case labels 100 disposed on a backing 210. The rolls 200 can be pre-printed, for example on a thermal transfer printer with a rewinder or a flexographic web press with variable data capability, days or months prior to use in a harvest. Exemplary rolls 200 comprise 500 to 2,000 labels, depending on the size of the roll 200, the size of the core, and the size and orientation of the case labels 100. In some embodiments, rolls 200 comprise 1,950 case labels 100. As noted in FIG. 2, an exemplary case label 100 is approximately 3" high×4" wide. In a set of rolls 200, every case label 100 on every roll 200 in a set has the same company identifier and SKU-specific information, every case label 100 shares a common batch number 160 on each roll 200 that differs from roll 200 to roll 200, and every case label 100 on a roll 200 optionally can have a unique code 130. It will be appreciated that in the alternative to rolls 200, the case labels 100 can also be provided on sheets and fan-folded strips.

The system that prints the case labels 100 also stores company, SKU and batch information, and any ranges of unique codes 130 that were printed, either locally or uploads the information to be stored by a central server that may be either an enterprise server or a hosted server, for example. The printing system or the central server can store a plurality of batch numbers 160 in association with a particular record of information that is common to all of the case labels 100 on each of the rolls 200 in the set such as SKU, company name, country of origin, and so forth. For each batch number 160, any ranges of unique codes 130 that were printed on the case labels 100 bearing that batch number 160 are also stored. The information can be stored in database that resides in a memory device such as a hard disk drive, a magnetic tape, a Compact Disc, a random access memory (RAM), and so forth.

Figure 3:
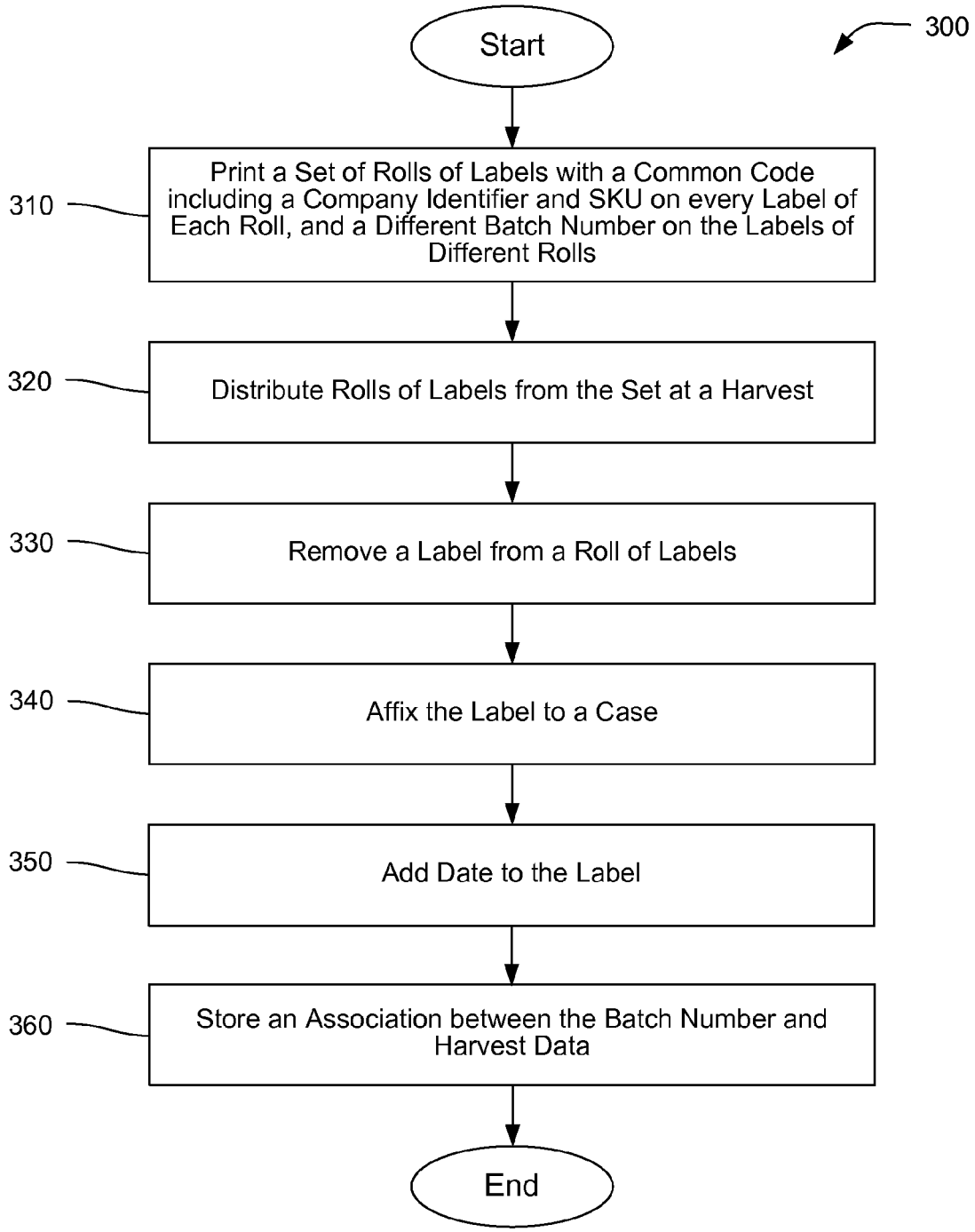
FIG. 3 shows a flowchart representation of a method for providing case-level traceability according to an exemplary embodiment of the present invention.

Methods for providing case-level traceability are also provided herein. FIG. 3 is a flowchart representation of an exemplary method 300 for providing case-level traceability to field-harvested produce. The method 300 comprises a step 310 of printing a plurality of case labels 100, for example, for use in conjunction with harvesting green bell peppers. For instance, the plurality of case labels 100 can be printed and wound onto a number of rolls 200 that collectively comprise a set of rolls 200. Each case label 100 of each roll 200 of the set includes certain common information such as the company, SKU, the country of origin, etc. Since different packaging for the same produce requires a different SKU, several sets of rolls 200 can be printed in step 310, one set for each SKU that may be used for a particular harvest. Those sets of rolls 200 that are not actually used because they comprised SKUs that were not appropriate for a particular harvest can be retained for a subsequent harvest. Even those unused rolls 200 from a set that is used are not wasted as they can be added to another set of rolls 200 bearing the same SKU.

In addition to printing the same information on every case label 100 of a roll 200, the step 310 also comprises printing different batch numbers 160 on different rolls 200 within the set. In some embodiments, each roll 200 comprises a separate batch number 160, though it will be appreciated that having more than one roll 200 associated with the same batch number 160 will still work, although it is less desirable Likewise, the step 310 can also comprise printing a unique code 130 on every case label 100. Further, the step 310 also comprises storing information about the case labels 100 for later retrieval. As noted above, information common across all of the case labels 100 in the set of rolls 200 is stored in association with those batch numbers 160 used for the various rolls 200, and ranges of unique codes 130 can be further associated with particular batch numbers 160, in various embodiments.

As noted previously, factors such as market forces can dictate which of several possible SKUs will be used as the time of harvest. Accordingly, step 310 can comprise printing more than one set of rolls 200, one set for each possible SKU that might be used. At the time of harvest, a particular SKU is selected for the harvest and the set of rolls 200 for the desired SKU is brought to the harvest.

The method 300 further comprises a step 320 of distributing rolls 200 of case labels 100 from the set at the harvest. For example, packers working in the field being harvested are provided with rolls 200. Each packer can receive a roll 200, however, since the rolls 200 are not identified to the packers in this embodiment, packers also can share rolls 200. A packer that finishes a roll 200 can obtain from the set a new roll 200 having a different batch number 160.

The method 300 further comprises a step 330 of removing a case label 100 from a roll 200 of case labels 100 and a step 340 of affixing the case label 100 to a case. These steps are repeated for each case that is packed. Case labels 100 can be removed from their backing and affixed manually, or through the use of a labeling gun or labeling machine, for example. Case labels 100 can be affixed to the produce cases either before, during, or after the harvest event. Case labels 100 can also be affixed to the produce cases before or after the produce cases are packed.

The method 300 can also include an optional step of adding the date to the case label 100. It will be understood that the harvest event data that is associated with the SKU and batch number 160 in the step 360 (discussed below) will typically include the date, so adding the date to the case label 100 in step 350 is not essential to recording the date. However, in some instances having a harvest or packing date visible on the exterior of a case is either desirable or required. In various embodiments the date is added by stamping the case label 100 with an inked stamp. In other embodiments the case label 100 is itself labeled with the date, such as with a labeling gun. Step 350 can be performed in the field or later, for example, when the cases are palletized such as at the cooler.

Figure 4:
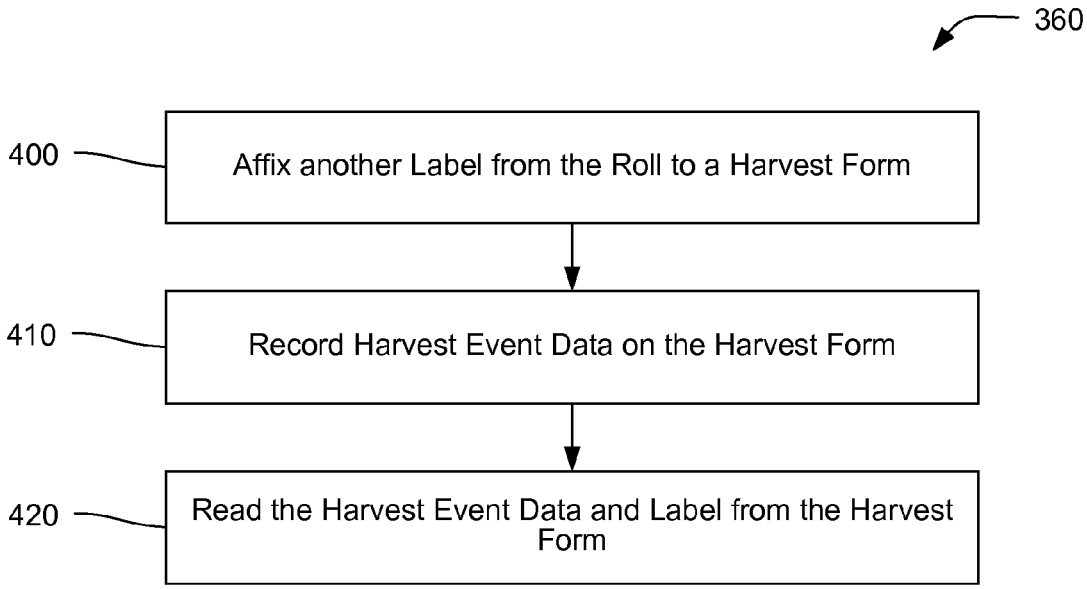
FIGS. 4 and 6 each show flowchart representations alternative methods for storing an association between a batch number and harvest data, according to two exemplary embodiments of the present invention.
Figure 6:
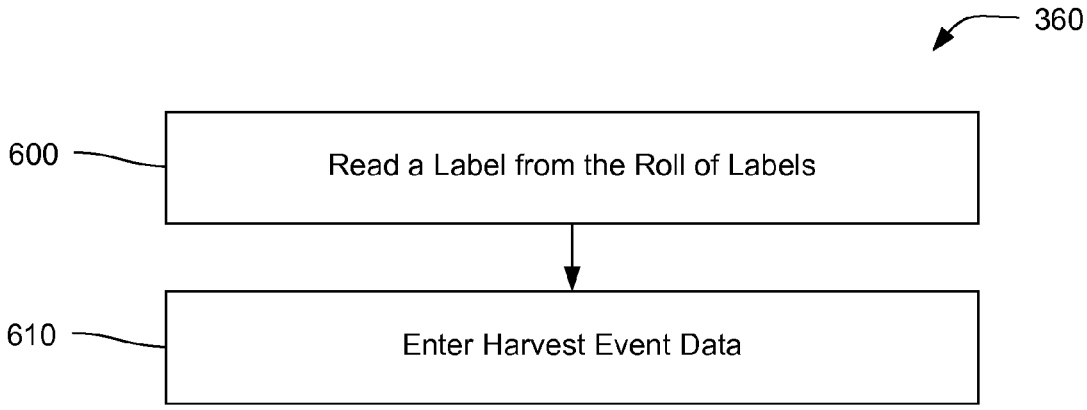

The method 300 further comprises a step 360 of storing an association between the batch number 160 and harvest event data. Step 360 can be performed in a number of ways. One method for performing step 360 is illustrated in FIG. 4. The method shown in FIG. 4 comprises a step 400 of affixing another case label 100 from the roll 200 to a harvest form, a step 410 of recording harvest event data on the harvest form, and a step 420 of reading the harvest event data and label from the harvest form. This method is further illustrated with reference to FIG. 5.

Figure 5:
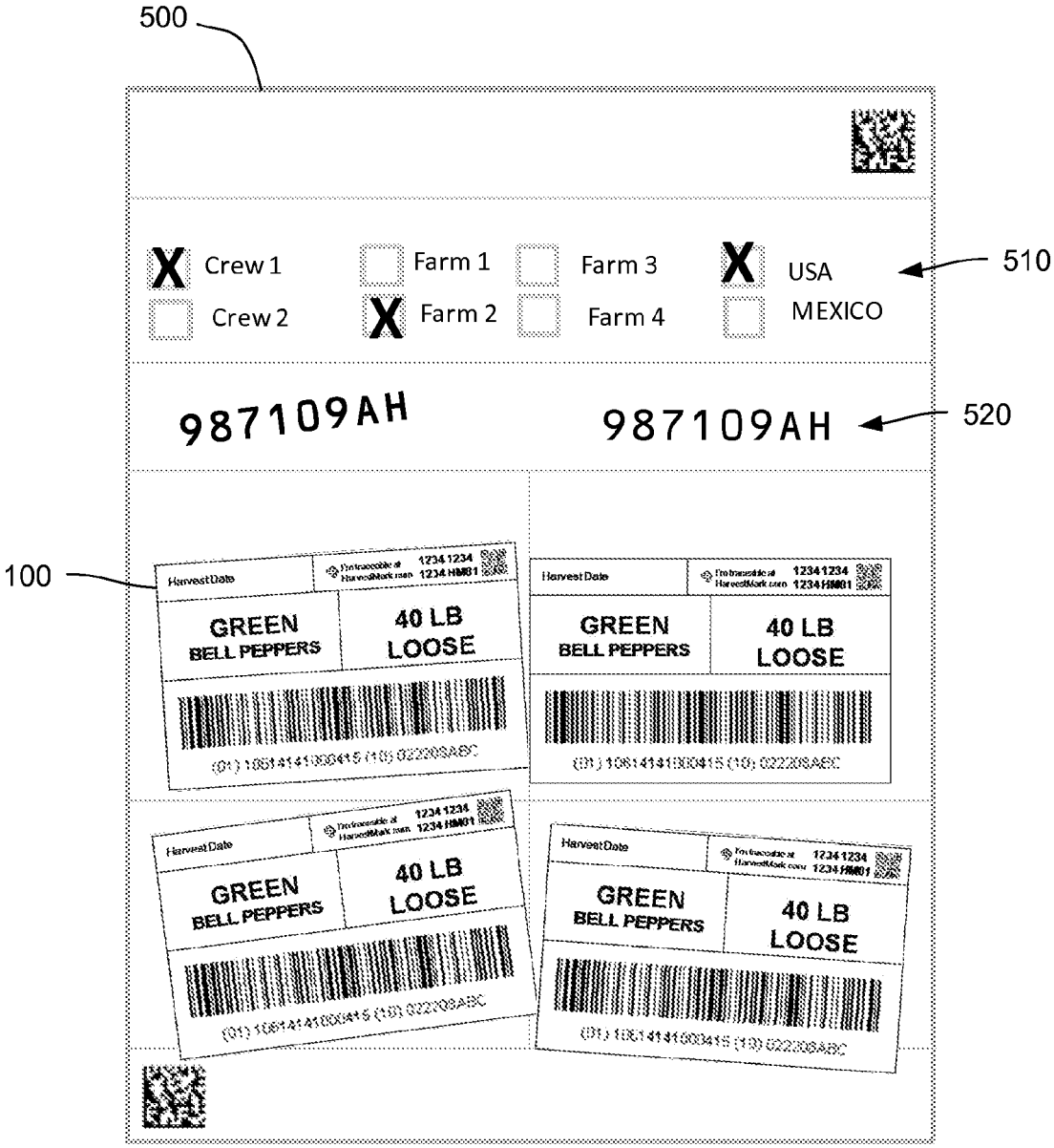
FIG. 5 shows a harvest form used to associate case labels with harvest event data according to an exemplary embodiment of the present invention.

FIG. 5 shows a harvest form 500 including case labels 100 from rolls 200 used during the harvest and affixed to the harvest form 500 in the step 400. The harvest form 500 also includes harvest event data added during step 410. The harvest event data can comprise any or all of hand-written entries, check boxes 510, and harvest stamps 520. Check boxes 510 provide convenience and can be machine read, in some instances. A harvest stamp 520 is a marking made by a rubber stamp (also referred to as a harvest stamp) that includes numbers and/or letters that is commonly used to stamp cases of produce. The harvest stamp 520 can encode information such the ranch, the date, etc. but typically will have no meaning to the casual observer.

Referring again to FIG. 4, in step 420 harvest event data and the one or more case labels 100 from the harvest form 500 are read. Reading the case label 100 can comprise scanning the case label 100, for example, with a barcode reader embodied in a handheld scanner connected to a PC. Reading the harvest event data can likewise be performed by an optical scanner configured to read check boxes and/or to perform optical character recognition. A flatbed scanner can be used to create an electronic image of the harvest form for processing and record keeping purposes. Reading 420 the harvest form can be performed away from the field to keep electronic scanning equipment clean of dust and dirt. Information read from the case label 100 such as the batch number 160 and the code 150 can be stored in association with the harvest event data in a local or remote database, as previously provided.

In the alternative to using harvest forms 500, step 360 can be carried out by reading, in a step 600, a case label 100 from each roll 200 that is distributed in step 320. Each case label 100 can be read by scanning with a handheld scanner, for example, either while the case label 100 is still on the roll 200 or after the case label 100 has been affixed to a case. More specifically, either the batch number 160 is read, or in some instances a unique code 130 is read. The unique code 130, having been associated previously with the batch number, can always be used to find the batch number 160.

In a step 610 harvest event data is also entered. Harvest event data can be entered, in some embodiments, through the same scanner used to read the case label 100 in step 600, for example with a touch-screen. In other embodiments, the scanner is used to scan selected barcodes from a preprinted laminated card or sheet to assign data. Combinations of scanning barcodes and entering data through the scanner can also be used. In some embodiments, the scanner prompts the user to scan a case label 100 and then prompts the user to enter the harvest event data, and in this way the scanner associates the harvest event data to the information read from the case label 100. The associated information can then be uploaded from the scanner and stored as described above.

As previously noted, partially used rolls 200 that remain after a harvest is completed do not need to be wasted, but can instead be used in a subsequent harvest where the same SKU is required. It will be understood that reusing a roll 200 will result in the same batch number 160 being associated with more than one harvest event. As will be explained below, although this can create a degree of ambiguity, the ambiguity does not pose a meaningful obstacle.

In the event that a situation arises in which the source of a unit of produce needs to be determined, the database that stores the harvest event data in association with information read from the case labels 100 can be queried based on whatever information is available at the time to narrow the search for the source to a particular harvest event. Once a harvest event has been identified, the database can be used to then trace forward to find all other cases associated with that harvest event. In the event that a roll 200 of labels 100 was used for two harvest events, for example, then tracing backward would identify two harvest events as the source. In most situations, however, the true source will become evident as other independent units are traced backward to only one of the two harvest events. Even if the one unit is the only one traced backward, being able to quickly narrow a source of a problem to two possible harvest events is still a substantial narrowing so that any remedial action can be narrowly tailored.

In an industry where profit margins are often razor thin, the present invention provides traceability back to a harvest event and forward from the harvest event to those cases packed at that harvest event through the use of very inexpensive preprinted labels 100 that may also satisfy various other labeling requirements, such as a requirement to display country of origin. The capital equipment costs to implement the invention are modest, comprising scanning equipment, computer equipment, and networking equipment. The application of pre-printed labels 100 is so fast and simple that the labor cost to implement the invention is negligible. In some embodiments additional information like the date is added to the labels 100 at the time of the harvest event, however, in these embodiments the additional information is added through the use, for example, of inked rubber stamps which are well suited for use in harvest fields, and also very inexpensive and simple to use.

Figure 7:
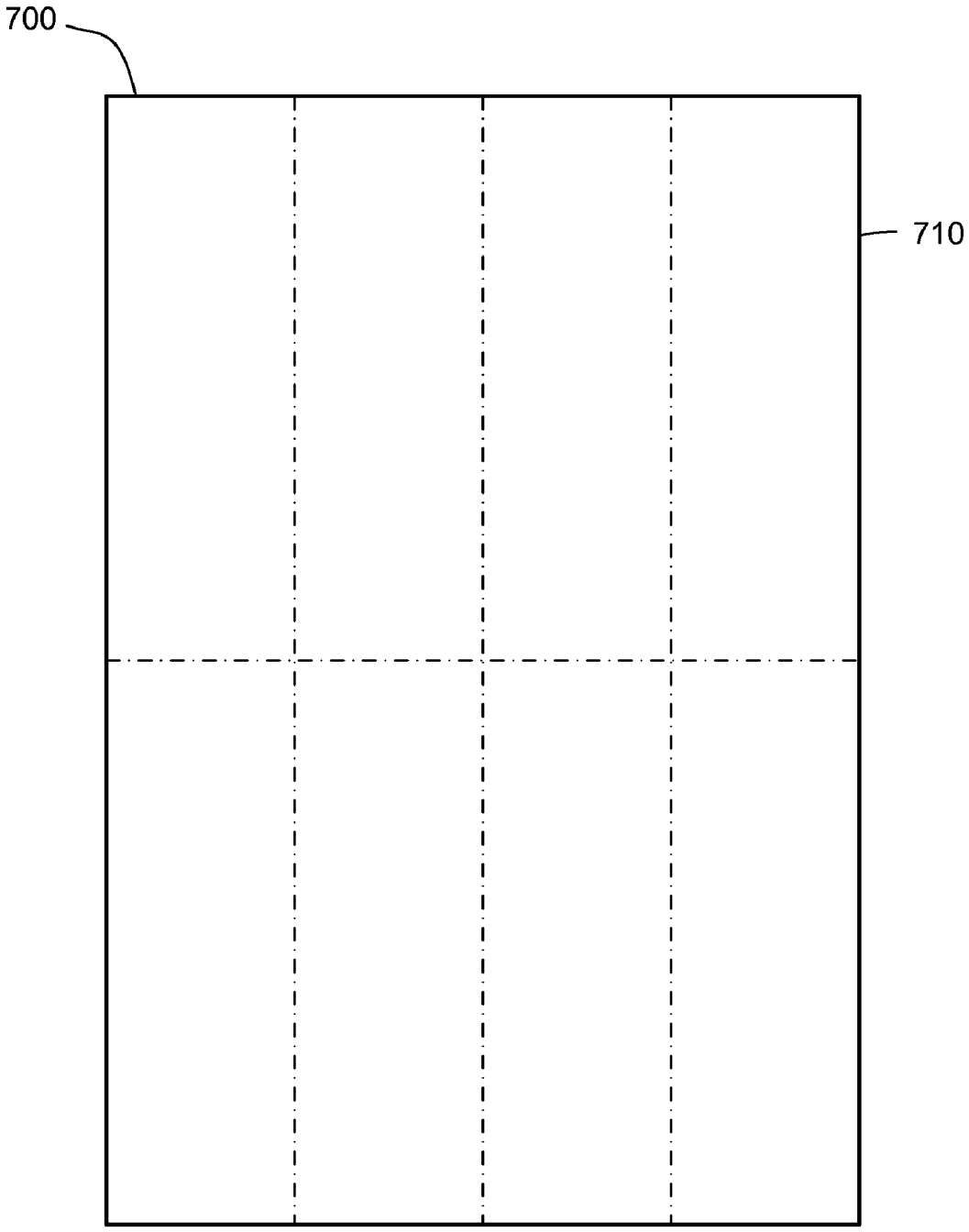
FIG. 7 shows an agricultural field subdivided into blocks.

In a similar manner to the inventions described above, pickers can be associated to cases or trays for accounting of picker productivity, for example. In addition, or in the alternative, each case or tray can be associated to a particular subdivision of a field, commonly referred to as a block. As shown in FIG. 7, agricultural fields 700 are frequently subdivided into blocks 710. Crops within a given block 710 are normally all of the same variety, are planted on the same date, and receive the same treatments such as applications of fertilizers, watering, pesticides, and so forth. Differences between blocks 710 allow farmers to make side-by-side comparisons of different growing techniques and treatments. At harvest time, a crew of pickers will harvest from a single block 710, and once the block 710 is sufficiently harvested, the crew will move to another block 710.

Figure 8:
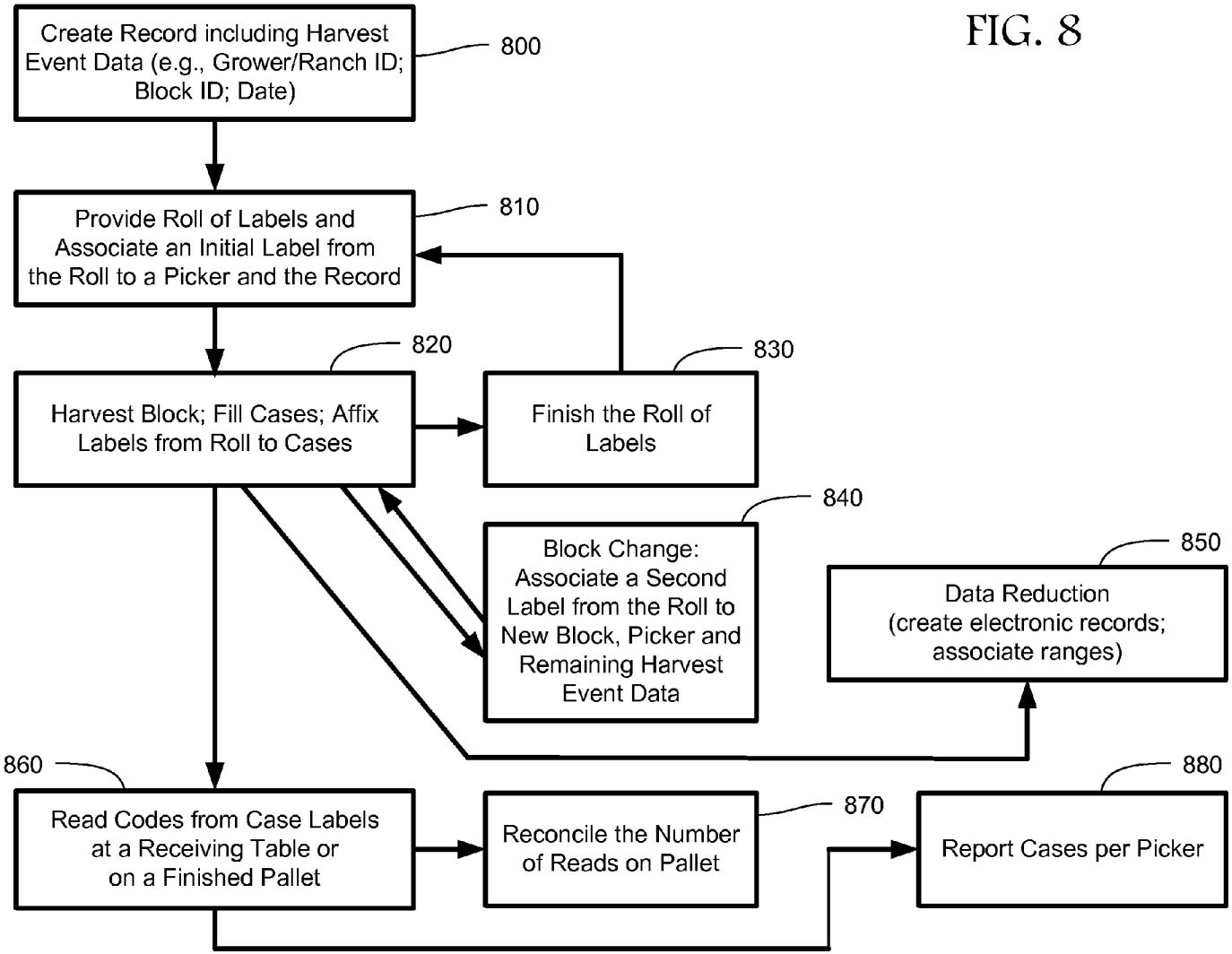
FIG. 8 shows a flowchart representation for various additional methods of the present invention.
Figure 9:
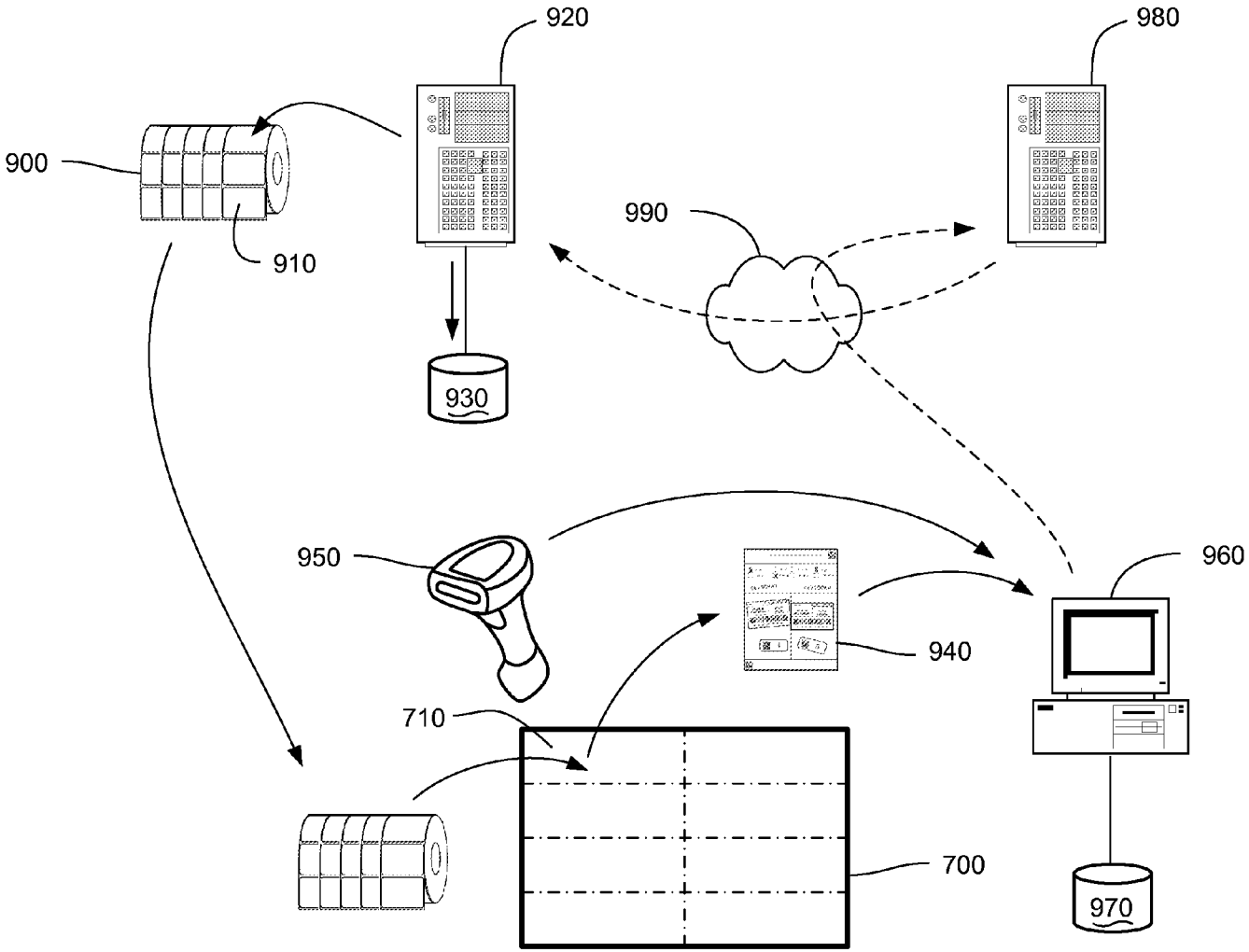
FIG. 9 shows a partial schematic overview of methods of the invention provided by FIG. 8.
Figure 11:
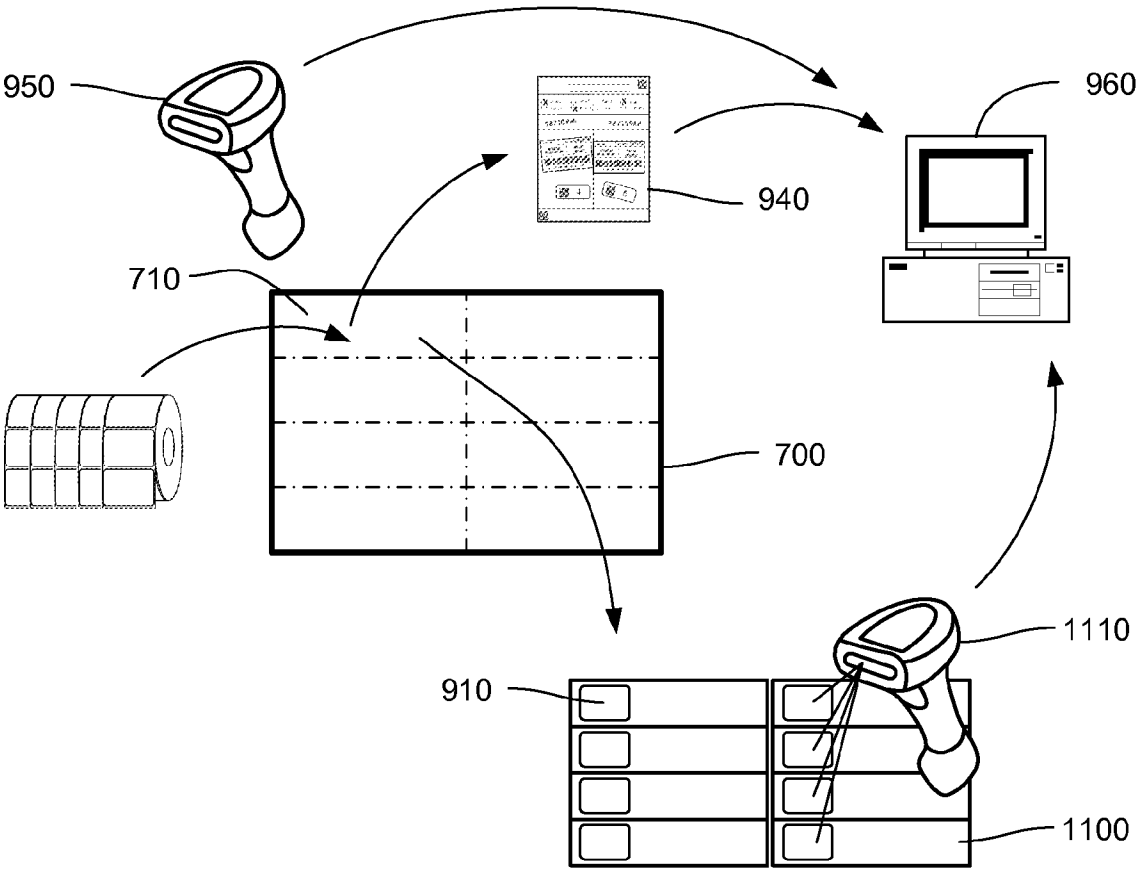
FIG. 11 shows a further partial schematic overview of methods of the invention provided by FIG. 8.

FIG. 8 provides a flow chart representation of these further inventions, while FIGS. 9 and 11 provide schematic overviews of the flow of materials and information. With reference first to FIG. 9, a label supplier produces rolls 900 of labels 910, illustrated generally by roll 200 (FIG. 2), where each label 910 includes a unique code which may be encrypted or unencrypted. Each label 910 optionally can also include a company identifier and a SKU, as provided above. The unique codes on each roll 900 follow a sequence, which for the purposes of this application means that where the unique codes on the roll 900 are unencrypted, the unique codes themselves follow some sequence, whereas encrypted unique codes on a roll 900 show no apparent relationship between the unique codes on successive labels 910, but the underlying decrypted codes follow the sequence. Encryption of sequential codes is described in more detail in U.S. patent application Ser. No. 12/143,016 filed Jun. 20, 2008 and entitled "Duo Codes for Product Authentication" which is incorporated herein by reference.

The label supplier may generate the unique codes or may receive the unique codes from another party, as discussed below with respect to FIG. 13. The label supplier has a first computing system 920 that directs label-making equipment to produce labels 910 bearing the unique codes and in some embodiments stores the range for each roll 900 in a searchable unique codes database 930. In some alternative embodiments, where another party supplies the unique codes to the label supplier, the other party provides the ranges for a given number of rolls 900 and maintains those ranges in the unique codes database 930. Thus, in these embodiments, the first computing system 920 need only direct the label making equipment and does not have to communicate used ranges to the unique codes database 930. As shown in FIG. 9, rolls 900 are then supplied to a farm, for instance, to be distributed at an agricultural field 600 to pickers to use during a harvest event.

Returning to FIG. 8, at the time of a harvest, in a step 800, harvest event data is associated together to create a data record, for example, by recording harvest event data on a harvest form 940 or by entering harvest event data into a handheld electronic device 950. Harvest event data has been described previously, but can also include a block identification associated with a block 710 of a field 700 and/or a picker identification associated with a picker. Recording harvest event data on harvest form 940 can comprise handwriting, ink stamps, and/or applying pre-printed labels to the harvest form 940 such as described below with respect to FIG. 10. The picker identification can be an identification number assigned to the picker and provided on a badge, for example. Harvest event data recorded on harvest forms 940 are subsequently transferred to an electronic data record for long-term storage and access, as described below.

Associating harvest event data to create a data record can alternatively comprise entering harvest event data into handheld electronic device 950. The handheld device 950 is optionally configured to read machine-readable codes such as bar codes and QR codes, such as found on pre-printed labels and on pickers' badges. The handheld device can be a smartphone or tablet device like an iPad, in some embodiments, or a device with a grip and a trigger, as shown in FIG. 9 and described in greater detail, for example, in U.S. patent application Ser. No. 12/908,667 filed Oct. 20, 2010 and entitled "Methods for Correlating First Mile and Last Mile Product Data" which is incorporated herein by reference. In various embodiments the handheld device 950 is configured to create the data record as an electronic data record by storing associated harvest event data in a memory device. The handheld device 950 is configured to communicate either wirelessly or over a physical medium to a computing system 960, either in real-time or on an as-needed basis, to upload electronic data records to the computing system 960.

In a step 810, at the field 700 and optionally at a block 710 thereof, a roll 800 of labels 910 is provided to a picker having a picker identification. Next, an initial label of the roll 900 is associated to the data record. In those embodiments in which harvest event data is entered into a handheld electronic device 950, the initial label can be read by the handheld device 950 while the initial label is still adhered to the roll 900. The handheld device 950 then associates the unique code to the current data record. The initial label can be the first label 910 on the roll 900, but need not be. A partially used roll 900 of labels 910 can be provided to the picker and the unique code of the next available label 910 on the roll 900 is read by the handheld device 950 and associated with the data record.

Figure 10:
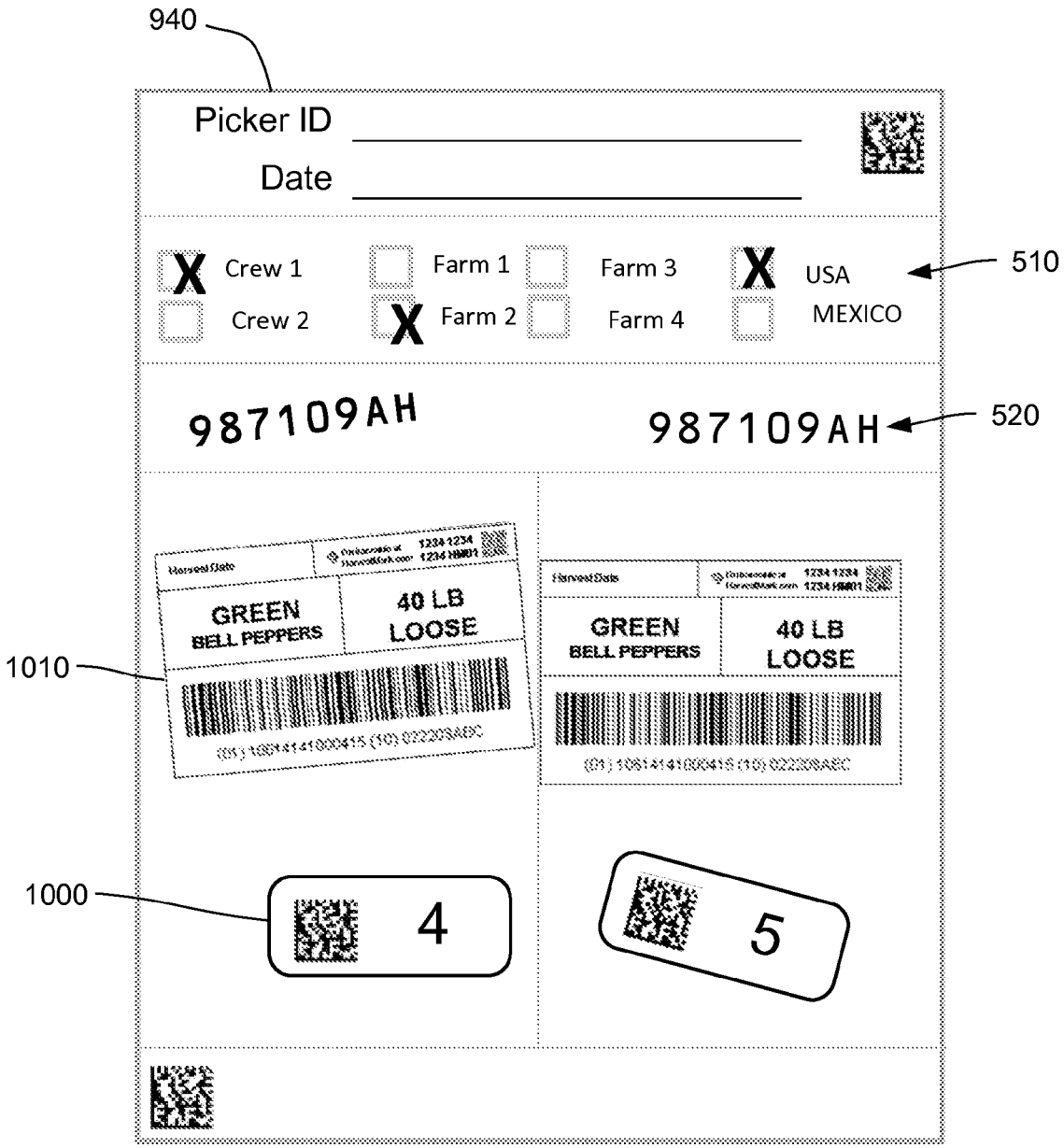
FIG. 10 shows a harvest form used to associate case labels with harvest event data and block changes according to another exemplary embodiment of the present invention.

FIG. 10 shows a harvest form 940 according to an exemplary embodiment of the invention. The harvest form 940 is configured to receive harvest event data in various forms including hand-written entries, check boxes 510, and/or harvest stamps 520. For example, a picker can write a picker identification and date where indicated on the top of the harvest form 940. A block identification can be recorded by hand or optionally can be recorded on the harvest form 940 using a block identification label 1000. In those embodiments in which harvest event data is recorded on a harvest form 940 in step 800, in step 810 an initial label 1010 is removed from the roll 900 and affixed to the harvest form 940. As above, the initial label 1010 need not be the first label on the roll 900. When a partially used roll 900 of labels 910 is provided to the picker in step 810, the picker affixes the next available label to the harvest form 940 as the initial label 1010.

Returning to FIG. 8, and with reference now to FIG. 11, in a step 820 the picker next harvests produce from the field 700 or more specifically from the block 710, fills cases 1100 with the harvested produce, and affixes labels 910 from the roll 900 to the cases 1100. Any or all of the steps of harvesting, filling cases 1100, and affixing labels 910 to the cases 1100 can be performed manually or mechanically. In some instances, during step 820, the picker will exhaust the roll 900 of labels 910 during the shift. In these situations, in an optional step 830, the picker is provided with another roll 900 of labels 910, returning in the process of FIG. 8 to step 810, where an initial label of the new roll 900 is associated with a data record in a manner as previously described.

At other times the block 710 will be sufficiently harvested before the end of the shift and therefore the picker will be assigned to begin work on a new block 710 in an optional step 840. In those embodiments in which creating a data record in step 810 comprises entering harvest event data into a handheld electronic device 950, the new block identification can be entered and the unique code of the next available label of the roll 900 can be read. The handheld device 950 then associates the new block identification to the read unique code and the process returns to step 820.

In those embodiments in which creating a data record in step 810 comprises entering harvest event data on harvest form 940, a new block identification can be entered on the harvest form 940, such as by affixing a new block identification label 1000. Similarly, the next label 1010 can be removed from the roll 900 and affixed to the harvest form 940. It is noted that in the scenario noted above, where a roll 900 is exhausted but the block 710 does not change, the initial label from the new roll 900 can be affixed to the harvest form 940 either with a new block identification label 1000, or without any block identification label 1000.

A data reduction step 850 occurs, in some embodiments, at a later time, such as after the completion of a shift. This step can include creating electronic data records from the data records provided by the harvest forms 940 that were used during the shift. With reference again to FIG. 9, the data records can be entered from the harvest forms 940 and into the computing system 960 manually, through the use of optical scanners and optical character recognition software, and/or through the use of fixed or handheld barcode readers. The computing system 960 associates together the unique code of the label 1010 affixed to the harvest form 940 with the picker identification and/or the block identification as an electronic data record that is stored in a searchable database 970. It is noted that the step 850 does not include creating electronic data records in those embodiments in which electronic data records are initially created by entering harvest event data into the handheld electronic device 950 in step 800, as such electronic records were previously created and uploaded to computing system 960.

It will be appreciated that although database 970 is illustrated in FIG. 9 as attached locally to computing system 960, in various embodiments the database 970 is remote to the computing system 960 and the computing system 960 communicates the electronic data records to a computing system 980, across a network 990 such as the Internet, and computing system 980 includes the database 970. In some of these embodiments the same party that supplies unique codes to the label supplier also receives and stores the electronic data records in the database 970, and in some further embodiments databases 930 and 970 are the same database, as described below with respect to FIG. 13.

The data reduction step 850 can also comprise associating ranges of unique codes with the electronic data records. Here, each unique code associated with harvest event data in steps 810 or 840 is used to search the unique codes database 930 to identify a range of unique codes that the searched unique code falls within. This can comprise decrypting the searched unique code and searching the unique codes database 930 using the decrypted code. In various embodiments, this component of step 850 is performed by the computing system 980 or by the computing system 960. The computing system 960, 980 that performs step 850 is configured to have access to the unique codes database 930.

Once ranges have been identified for the searched unique codes, all or part of each identified range is associated with the electronic data records in database 970. For example, in those instances where a unique code is the first unique code of a range and no other searched unique code falls within that same range, then the entire range is associated to that unique code and to the associated data record. This would happen, for instance, where a picker was given an unused roll 900 of labels 910, the picker used all of the labels 910 during one shift, and spent the entire shift within one block 710. In other instances where the unique code is not the first unique code of the associated range but is still the only searched unique code identified as being within that range, then the entire range following the searched unique code is associated to that searched unique code and to the associated data record. This can occur, for example, where the picker begins a new block 710 with a partially used roll 900.

Where more than one unique code is identified within the same range, as occurs when a roll 900 is used across a block change, for example, the range is split between the several unique codes. In an example where a partially used roll 900 is used to complete one block 710, and then is further used on a next block 610, there would be two searched unique codes that would match with one stored range, and neither would be the first unique code of the range. Here, any unique codes in the identified range that precede the first of the two searched unique codes would be disregarded, the unique codes in the range that follow the first of the two searched unique codes and precedes the second of the two searched unique codes would be associated with the first of the two searched unique codes, and the remaining unique codes of the range would be associated with the second of the two searched unique codes.

It will be understood that unique codes can become associated with electronic data records even though the labels 910 including those unique codes were never actually applied to cases 1100. This does not pose a problem if the labels 910 are never used. On the other hand, if the remaining labels 910 are used for a subsequent harvest event the unique codes on the remaining labels 910 can end up associated with both the initial and the subsequent harvest events. In some instances the computing system 960 or 980 will then remove the unique codes of the remaining labels 910 from the unique codes associated with the earlier electronic data record. Even if not, and a later search of a unique code returns two matching electronic data records, it should be apparent that the later association supersedes the earlier.

Various embodiments of the invention additionally include an optional step 860 of reading unique codes from labels 910 on filled cases 1100 at a table or on a finished pallet, for example. Since pickers have been associated to unique codes in known ranges, any case 1100 that is verified as filled can be credited to a picker by reading the unique code of the label 910 on the filled case 1100 to then determine which picker's range the read unique code falls within.

Therefore, as shown in FIG. 11, at any point where filled cases 1100 are aggregated, like at a table or on a finished pallet, the unique codes can be read from the labels 910 of the filled cases 1100, such as with a handheld electronic device 1110. Handheld electronic device 1110 may be the same device as handheld electronic device 950, in some embodiments, being configured in one mode to collect and associate harvest event data, while in another mode being configured to read unique codes of filled cases 1100. In other embodiments the handheld electronic device 1110 is a separately configured device. In either instance, the handheld electronic device 1110 is configured to communicate with a computing system having access to database 970, such as computing system 960 or 980, or still another computing system, such as one dedicated for accounting and payroll.

Thus, for each filled case 1100 that reaches the aggregation point, the database 970 is searched to determine an electronic data record having an associated range that includes the unique code from the label 910 on the filled case 1100. The picker having a picker identification also associated with that electronic data record receives credit for one filled case 1100. In some embodiments, in a step 870, the number of reads on a pallet is reconciled. Step 870 can be performed in those embodiments where the aggregation point comprises a pallet with a known capacity, for example, 110 cases per pallet. Reconciling the number of reads on a pallet can therefore comprise the handheld electronic device 1110 requiring that an operator thereof, for each pallet, complete a number of reads equal to the number of cases 1100 per pallet.

Advantageously, the picker does not have to be present when the unique code on the label 910 of the case 1100 is read in order to receive credit for the filled case 1100. Once all of the filled cases 1100 from the harvest event have been read, in a step 880 the number of cases 1100 per picker is reported.

Figure 12:
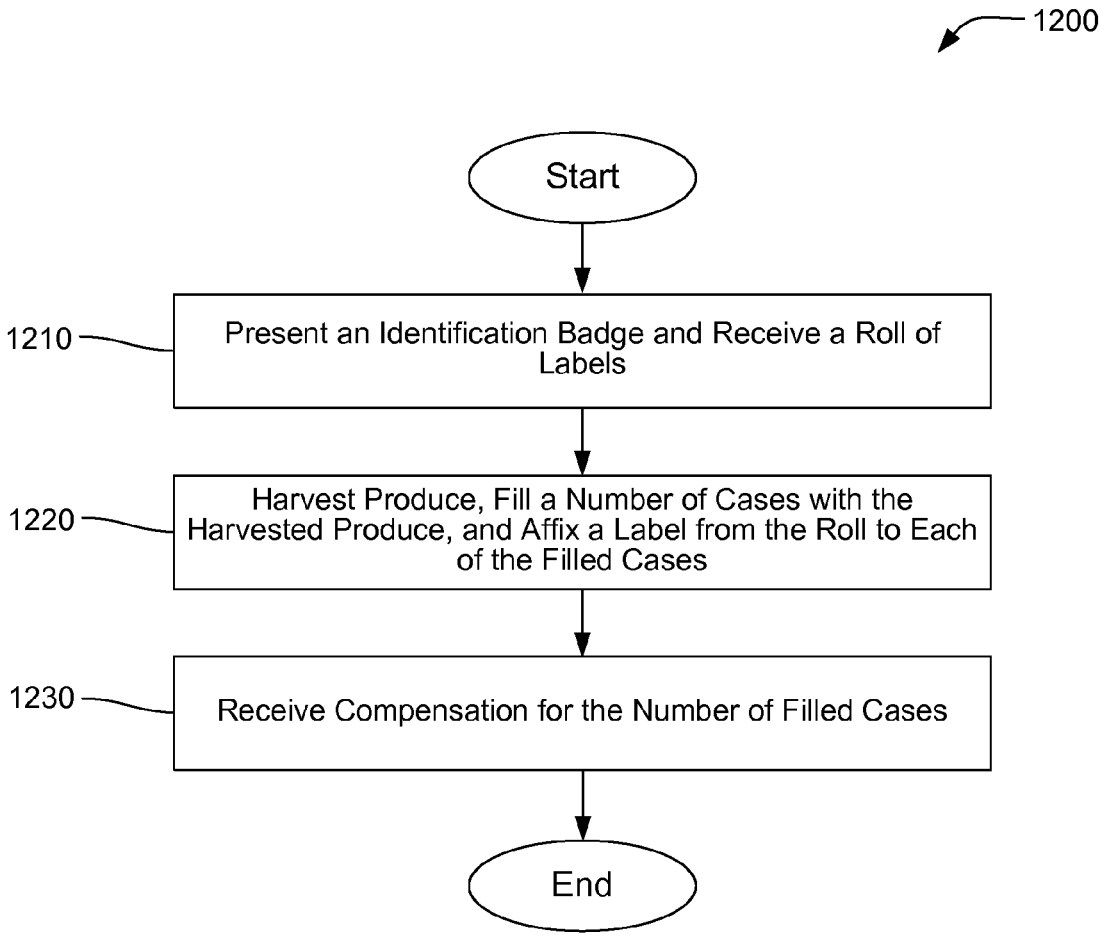
FIGS. 12 and 13 are flowchart representations for still additional methods of the present invention.

While the methods described with respect to FIGS. 8-11 are generally performed by a farmer and/or by the farmer's agents such as hired crews and optionally second parties that provide labels and/or information services, still other methods of the invention are performed by individual pickers, as illustrated with respect to FIG. 12. FIG. 12 shows a flowchart representation of an exemplary method 1200 of the invention for harvesting produce and receiving compensation based on the amount harvested.

In a step 1210, two events occur substantially coincidentally. The picker presents an identification badge to be read and receives a roll 900 of labels 910, in either order. In a step 1220 the picker harvests produce, fills cases 1100 with the harvested produce, and affixes labels 910 from the roll 900 to each of the filled cases 1100. Step 1220 is performed typically until the roll 900 is depleted or the shift ends. The picker may transport filled and labeled cases 1100 to an aggregation point, or the filled cases 1100 may be collected from the picker, for example, however the picker does not have to take further action to be credited for the number of cases 1100 filled. Thus, in a step 1230, the picker receives compensation for the number of filled cases 1100 without having to present the identification badge again for crediting purposes, as opposed to perhaps showing the identification badge to prove identity at the time of the compensation payout.

In some embodiments, a method of the invention is directed to receiving credit for harvested produce and consists of just steps 1200 and 1220 such that the picker only presents an identification badge to be read, receives a roll 900 of labels 910, harvests produce, fills cases 1100 with the harvested produce, and affixes labels 910 from the roll 900 to each of the filled cases 1100. By doing these steps and nothing more, the picker is credited for the number of filled cases 1100 produced by the picker. These methods are advantageous over prior art methods of receiving credit in which the picker must have his badge read each time filled cases 1100 are brought to an aggregation point, and in some instances must have the badge read once for each filled case. Not having to wait to have one's badge read in order to receive credit for harvested produce allows the picker to be more time efficient.

Figure 13:
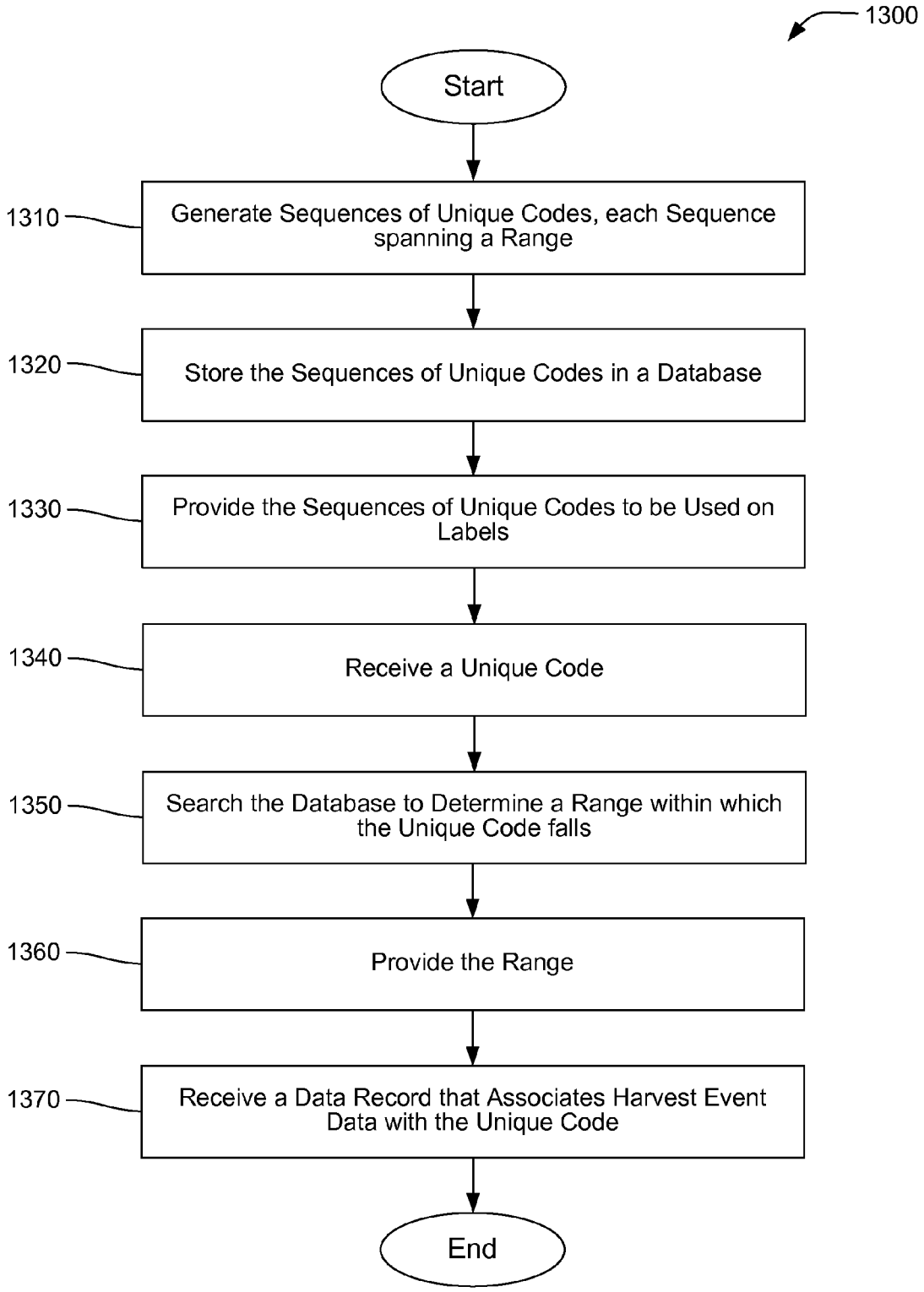

Still another exemplary method 1300 of the invention is illustrated generally by FIG. 13 and can be performed, for example, by a service provider that provides unique codes and maintains databases where data records are stored that associate harvest event data to the unique codes. These methods can be performed by computing system 980, for example. Some embodiments of method 1300 begin with a step 1310 of generating sequences of unique codes, where each sequence spans a range. Optionally, the sequences can be received from elsewhere, rather than generated by the service provider. In a step 1320 the sequences, or ranges, of unique codes are stored in a database (e.g. unique codes database 930), and in a step 1330 the sequences are provided to be used on labels. For example, the service provider maintains a database of unique code ranges and transmits ranges from the database to various label printers for use on labels 910. As an alternative, label printers can generate the ranges of unique codes and transmit the ranges to the service provider to store in the database.

In a step 1340, after labels 910 have been printed and put into use, a unique code is received, for example, as a database query from a computing system 960. Then, in a step 1350 the unique codes database 930 is searched to determine a range within which the unique code falls. The range is then optionally provided in step 1360 back to the source of the unique code in step 1340. The requestor, the computing system 960 in this example, then can associate the returned range, in whole or in part, with the unique code and with harvest event data including a block number and/or a picker identification.

In some embodiments, the computing system 960 does not perform the data reduction described with respect to step 850, and in some of these embodiments the computing system 980 receives the harvest event data in association with the unique code in step 1340. The computing system 980 then performs aspects of the data reduction step 850, with the results stored to database 970. In these instances, step 1360 and step 1370, below, may not be performed.

In those embodiments in which the method includes step 1360, a range is provided in the step to computing system 960, for example. In some embodiments, to properly credit pickers for harvested produce, the computing system 960 needs only to receive the range that is associated with the unique code from step 1340, as described above.

Still other embodiments include a step 1370 in which a data record comprising an association between harvest event data and the unique code is received. This can occur, for instance, where the computing system 960 requires the range provided in step 1360 in order to perform data reduction steps, and then transmits the resulting data record back to the computing system 980 to be stored in a database (e.g. database 970). Accordingly, the data record received in step 1370 can specify all or part of the range determined in step 1350 in association with the harvest event data, where the part of the range determined in step 1350 begins with the unique code received in step 1340.

Some embodiments of method 1300 further comprise steps of receiving quality assessment data from various sources such as consumers, retailers, and produce inspectors, where the assessments are associated with unique codes provided in step 1330. Gathering quality assessment data is described in greater detail in U.S. patent application Ser. No. 12/908,667 entitled "Methods for Correlating First Mile and Last Mile Product Data," noted previously. Thus, in these embodiments method 1300 can further comprise a step of comparing quality as a function of the block 710 from which produce was harvested by connecting quality assessment data to harvest event data that includes block numbers.

Some steps of the methods described herein can be performed, for example, through the use of hardware, such as application-specific integrated circuits (ASICs), specifically designed to perform the particular functions of the method. Various steps of the methods described herein can also be performed through the use of firmware residing, for instance, in read only memory (ROM) or flash memory, where the firmware is programmed to perform the particular functions of the method steps. Steps of the methods described herein can also be performed by a processor capable of executing software residing in a memory, for example, in random access memory (RAM), where the computer instructions embodied in the software define the method steps. Any combination of two or more of hardware, firmware, and software can also be employed. Hardware, firmware, and/or software for implementing method steps may be embodied in handheld scanners, for example. Hardware, firmware, and/or software for implementing method steps may also be embodied in various types of computing systems such as servers and personal computers. It will be appreciated that such computing systems, when configured to follow specific logic embodied in their circuits or programming instructions, or both, constitute specific machines.

In the foregoing specification, the invention is described with reference to specific embodiments thereof, but those skilled in the art will recognize that the invention is not limited thereto. Various features and aspects of the above-described invention may be used individually or jointly. Further, the invention can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

What is claimed is:

1. A method comprising:

generating sequences of unique codes with a microprocessor, each sequence spanning a range;

storing the sequences of unique codes in a database;

providing the sequences of unique codes to be used on labels;

receiving a unique code and harvest event data in association with one another; and searching the database to determine a range within which the unique code falls.

2. The method of claim 1 further comprising providing the determined range to the source of the unique code.

3. The method of claim 2 further comprising receiving harvest event data in association with the unique code after providing the determined range to the source of the unique code.

4. The method of claim 1 further comprising receiving quality assessment data associated with at least some of the unique codes within the provided ranges.

5. The method of claim 1 wherein the microprocessor and database are local to one another.

6. The method of claim 1 wherein the database is remote from the microprocessor.

7. The method of claim 1 further comprising using the range determined by searching the database to credit a picker for a harvested amount of produce.

* * * * *